US005618161A

United States Patent [19]

Papageorgiou et al.

[11] Patent Number: 5,618,161

[45] Date of Patent: Apr. 8, 1997

[54] APPARATUS FOR RESTRAINING MOTION OF A TURBO-MACHINE STATIONARY VANE

[75] Inventors: Theodore Papageorgiou; Kent G. Hultgren, both of Winter Park; Rocco J. Covelli, Winter Springs, all of Fla.

[73] Assignee: Westinghouse Electric Corporation, Pittsburgh, Pa.

[21] Appl. No.: 544,350

[22] Filed: Oct. 17, 1995

[51] Int. Cl.[6] ..... F01D 9/04

[52] U.S. Cl. ..... 415/190; 415/209.3

[58] Field of Search ..... 415/139, 189, 415/190, 209.3, 209.4, 138

[56] References Cited

U.S. PATENT DOCUMENTS

| | | | |
|---|---|---|---|
| 2,738,949 | 3/1956 | Wilkinson . | |
| 2,819,871 | 1/1958 | McVeigh . | |
| 2,862,357 | 12/1958 | Haworth et al. . | |
| 3,824,034 | 7/1974 | Leicht . | |
| 3,829,233 | 8/1974 | Scalzo et al. . | |
| 3,841,787 | 10/1974 | Scalzo . | |
| 3,843,279 | 10/1974 | Crossley et al. . | |
| 3,892,497 | 7/1975 | Gunderlock et al. . | |
| 4,274,805 | 6/1981 | Holmes . | |
| 4,286,921 | 9/1981 | Donlan et al. . | |
| 4,391,565 | 7/1983 | Speak | 415/190 |
| 4,492,517 | 1/1985 | Klompas . | |
| 4,511,306 | 4/1985 | Hultgren | 415/190 |
| 4,890,978 | 1/1990 | McLaurin et al. . | |
| 4,957,412 | 9/1990 | Olson et al. . | |

FOREIGN PATENT DOCUMENTS

| | | |
|---|---|---|
| 52-68612 | 6/1977 | Japan . |
| 2071776 | 9/1981 | United Kingdom . |

*Primary Examiner*—James Larson
*Attorney, Agent, or Firm*—M. G. Panian

[57] ABSTRACT

A stationary vane assembly for a turbo-machine in which the vane is restrained against motion in the circumferential direction by first and second locking pins. The second locking pin extends radially through a turbine cylinder and engages a notch in a downstream support rail formed on the vane outer shroud. The first locking pin is affixed to the front radial flange of the cylinder and has a projection that extends into a notch in an upstream support rail formed on the outer shroud. An over-sized slot in the first locking pin allows the circumferential location at which the first locking pin is fixed to the cylinder to be adjusted, thereby ensuring that the first locking pin can be pre-loaded against the outer shroud notch at assembly in a manner that will allow it to restrain the motion of the vane.

16 Claims, 4 Drawing Sheets

APPARATUS FOR RESTRAINING MOTION OF A TURBO-MACHINE STATIONARY VANE

BACKGROUND OF THE INVENTION

The present invention relates to a stationary vane assembly in a turbo-machine, such as a gas turbine. More specifically, the present invention relates to an apparatus for locking a stationary vane to a turbo-machine cylinder.

A turbo-machine, such as a gas turbine, is typically comprised of several rows of stationary vanes, each of which is disposed immediately upstream from a row of rotating blades. Typically, a number of stationary vanes—for example, three—are formed into an assembly by a common outer shroud. The outer shroud is slidably supported on the turbine cylinder. The airfoils of the stationary vanes are exposed to the flow of working fluid and, therefore, must be restrained against the force applied to the vanes by the working fluid that tends to urge the vanes in the circumferential direction.

Traditionally, a Single pin or bolt attached to the cylinder engages the vane assembly outer shroud so as to prevent relative motion between the vane assembly and the cylinder in the circumferential direction. In the case of the first row of stationary vanes, such restraint was accomplished by a bolt that extended through a support rail formed at the outer shroud Leading edge and into the cylinder flange. In the case of downstream rows of vanes, a radially extending pin was inserted through the cylinder so that it entered a slot formed in a support rail located near the outer shroud trailing edge.

Unfortunately, this approach has not always been entirely adequate in restraining the vane. This is especially so in those cases in which the vanes are not grouped into assemblies, in which case each vane has its own short outer shroud. The use of a short outer shroud increases the tendency of the vane to rotate about the radial restraining pin, thereby causing wear on the outer shroud where it contacts the cylinder and misalignment of the vane with respect to the flow of the working fluid. In addition, the tendency for the vane to rotate about a single restraining pin causes a torque load to be imparted to the outer shroud. Over time, such torque load can result in undesirable creep deformation.

It is therefore desirable to provide a stationary vane assembly in which the vane is restrained with respect to the cylinder at two locations proximate the leading and trailing edges of the outer shroud.

SUMMARY OF THE INVENTION

Accordingly, it is the general object of the current invention to provide a stationary vane assembly in which the vane is restrained with respect to the cylinder at two locations proximate the leading and trailing edges of the outer shroud.

Briefly, this object, as well as other objects of the current invention, is accomplished in a stationary vane assembly for a turbo-machine comprising (i) a vane airfoil having a shroud attached thereto, the shroud having first and second ends, one of the ends being disposed upstream of the other one of the ends, (ii) a cylinder having means for enclosing a flow of working fluid for the turbo-machine, (iii) first locking means for preventing relative motion between the vane and the cylinder, the first locking means having first means for engaging the cylinder and means for engaging the first end of the shroud, and (iv) second locking means for preventing relative motion between the vane and the cylinder, the second locking means having second means for engaging the cylinder and means for engaging the second end of the shroud, the second means for engaging the cylinder having means for adjusting the circumferential location at which the second locking means engages the cylinder.

In a preferred embodiment of the invention, the means for adjusting the circumferential location at which the second locking means engages the cylinder comprises a slot formed in the second locking means.

DESCRIPTION OF THE PREFERRED EMBODIMENT

Figure 1:
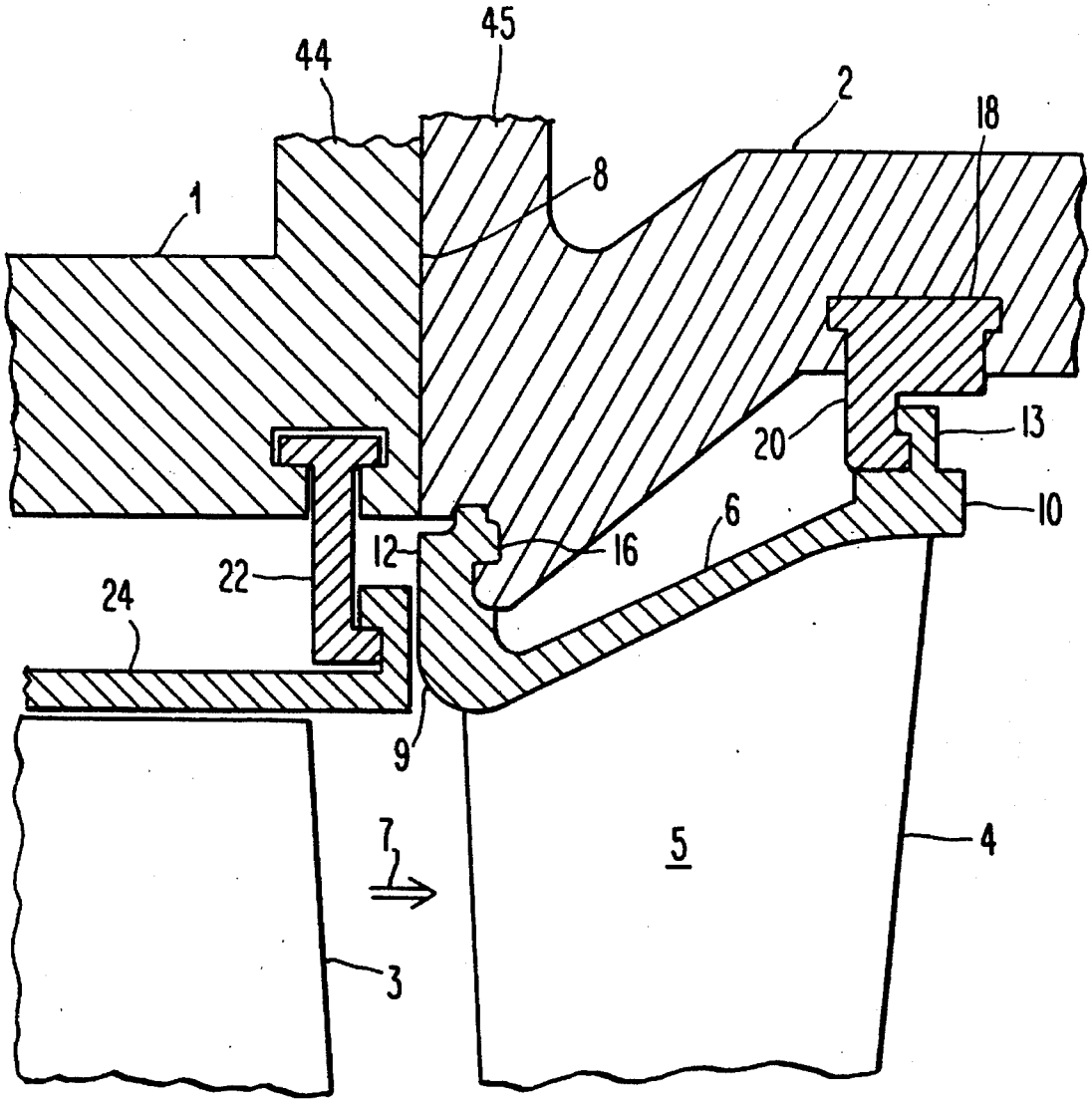
FIG. 1 is a cross-section through a portion of the turbine section of a gas turbine, showing the vane of the current invention in a location circumferentially offset from the location of the restraining apparatus of the current invention.

Referring to the drawings, there is shown in FIG. 1 a longitudinal cross-section through the turbine section of a gas turbine in the vicinity of the row 2 of stationary vanes. Cylinders 1 and 2 are joined along radially extending flanges 44 and 45 and enclose a flow of hot gas 7. The hot gas 7 flows over a row of rotating blades 3 and a downstream row of stationary vanes 4. A segmented support ring 22 Supports an inner segmented ring 24 on the cylinder 1. The inner ring 24 encloses the tips of the rotating blades 3.

The stationary vanes 4 are arranged in a circumferentially extending row. Each vane 4 is comprised of an airfoil portion 5 and an outer shroud 6 that is attached to one end of the airfoil. An inner shroud (not shown) is attached to the other end of the airfoil 5. The outer shroud 6 has leading and trailing edges 9 and 10, respectively. An upstream support rail 12 is formed on the outer shroud leading edge 9 that slidably engages a groove 16 formed in the cylinder 2. The support rail 12 restrains the vane 4 from motion in the downstream direction.

A downstream support rail 13 is formed on the outer shroud 6 proximate its trailing edge 10. The support rail 13 slidably engages a segmented ring 20 that is secured within a groove 18 formed in the cylinder 2. The downstream support rail 13 restrains the vane 4 from motion in the upstream direction.

Figure 2:
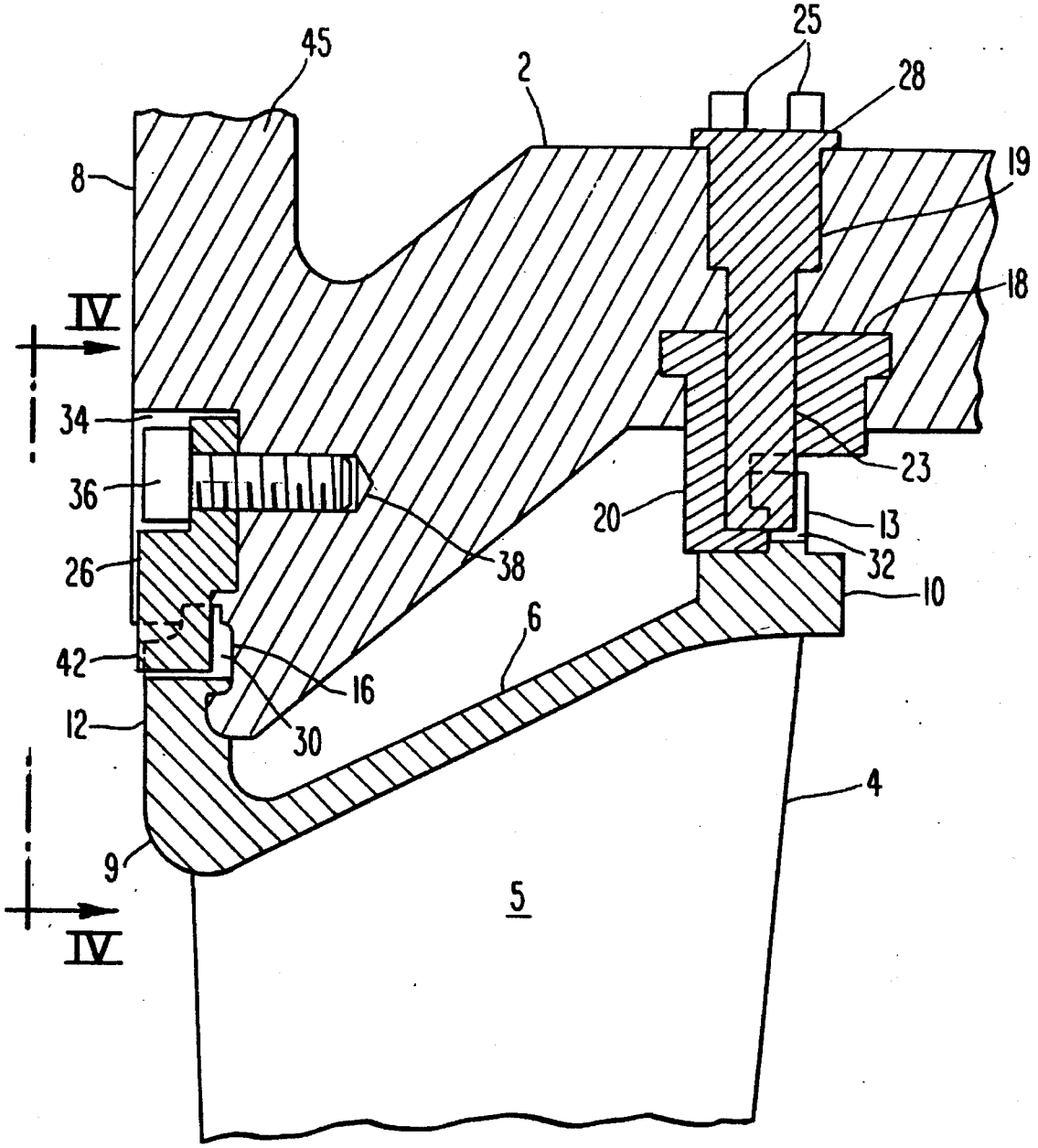
FIG. 2 is a vie$_w$, similar to FIG. 1 at the location of the restraining apparatus of the current invention.
Figure 3:
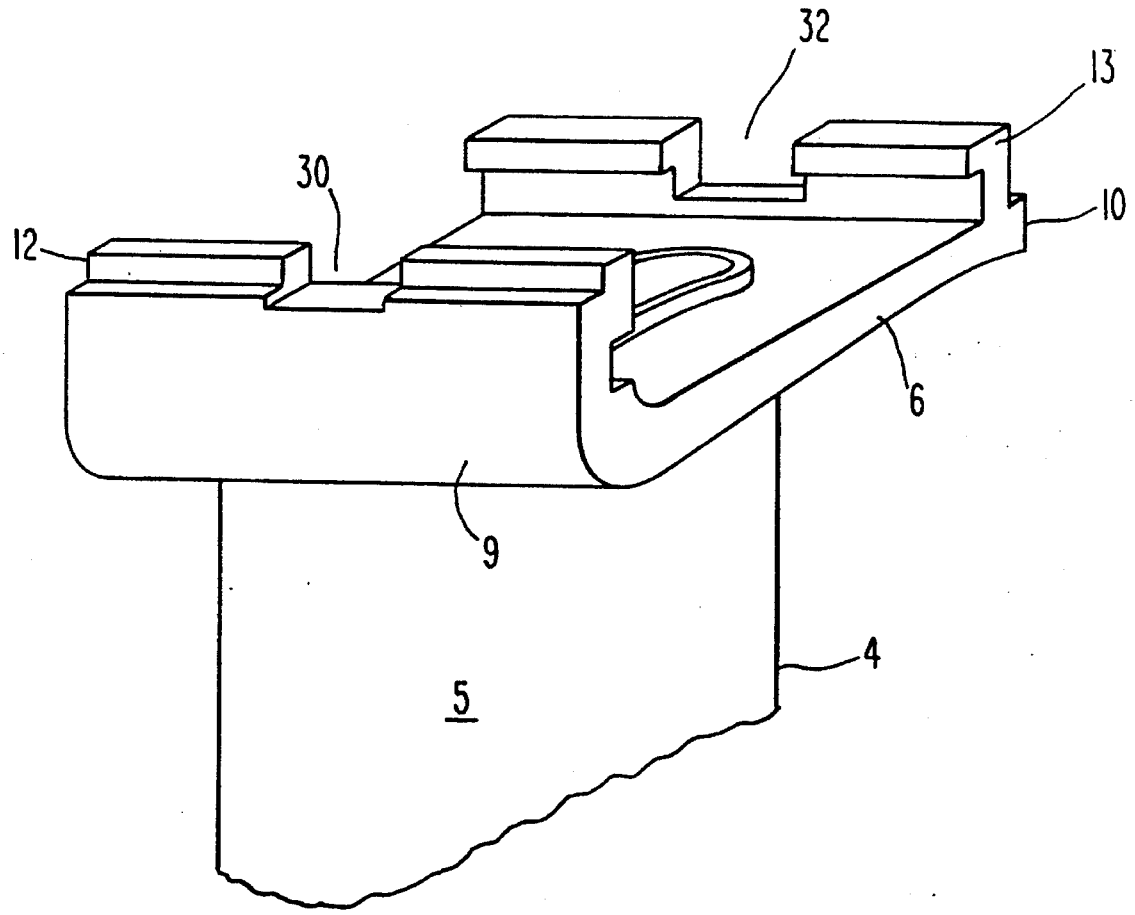
FIG. 3 is an isometric view of the outer shroud portion of the vane shown in FIGS. 1 and 2.

As shown in FIG. 2, as is conventional, a downstream locking pin 28 extends radially through a hole 19 in the cylinder 2. A pair of screws 25 secures the locking pin 28 to the cylinder 2. The locking pin 28 also extends through an aligned hole 23 in the ring 20 so that the distal end of the locking pin 28 enters a notch 32 formed in the downstream support rail 13, shown best in FIG. 3. Thus, the locking pin 28 restrains the vane 4 from motion in the circumferential direction.

However, as previously discussed, the force applied to the vane 4 as a result of the flow of the hot gas 7 over the airfoil 5 tends to cause the vane 4 to rotate about its radial axis. This rotation causes the airfoil 5 to become improperly aligned with respect to the flow of the hot gas 7, which is detrimental to the aerodynamic performance of the vane 4. In addition, although the outer shroud 6 offers resistance against the rotational force, such resistance imparts a torque load on the outer shroud that, over time, can cause undesirable creep deformation within the shroud.

Figure 4:
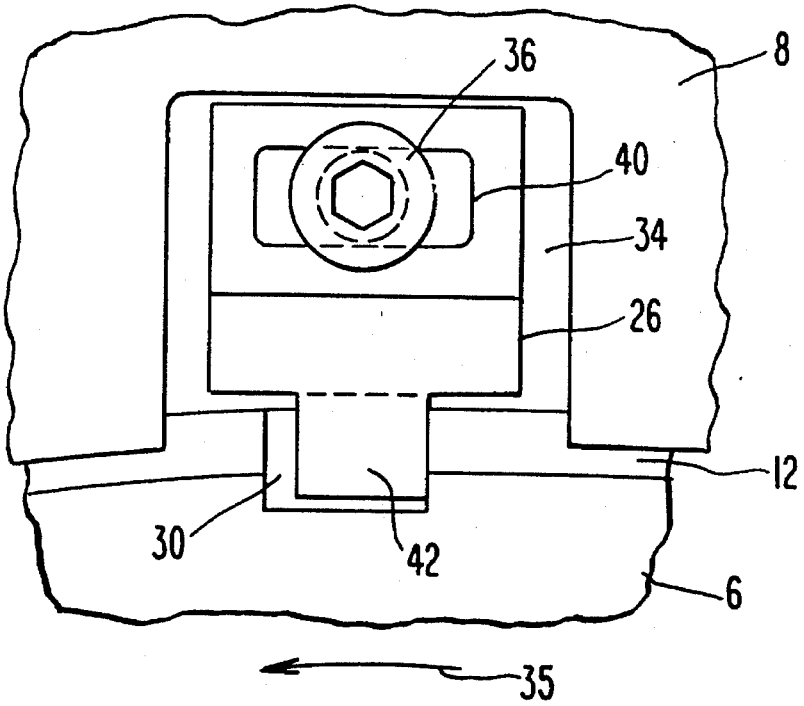
FIG. 4 is a view taken along line IV—IV shown in FIG. 2.
Figure 5:
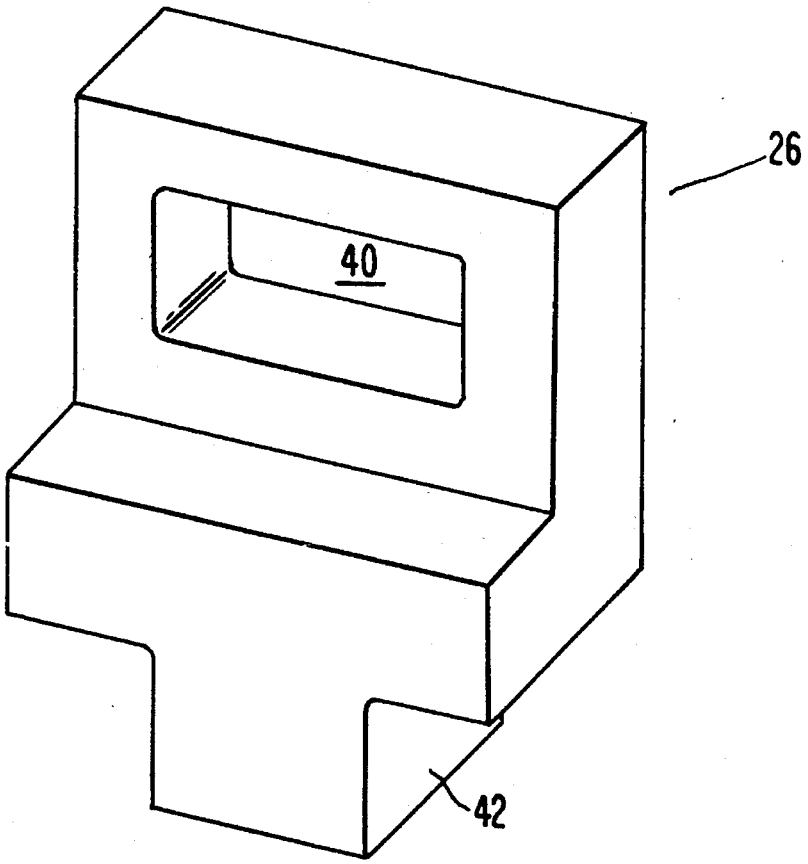
FIG. 5 is an isometric view of the leading edge locking pin shown in FIGS. 2 and 4.

Consequently, according to the current invention, the vane assembly also incorporates an upstream locking pin 26, shown in FIG. 5. As shown in FIGS. 2 and 4, the upstream locking pin 26 is located within a notch 34 formed in the front face 8 of the cylinder radial flange 45. A projection 42 formed at the distal end of the locking pin 26 extends into a notch 30 formed in the upstream support rail 12, shown in FIG. 3. The locking pin 26 is attached to the cylinder 2 by means of a bolt 36 that extends through a slot 40 in the locking pin and then into a threaded hole 38 formed in the cylinder 2. Since the metal from which the cylinder 2 is formed may be a relatively weak low alloy steel, a hard helical insert may be installed in the hole 38 to permit increased torquing of the bolt 36.

According to an important aspect of the current invention, the slot 40 in the upstream locking pin 26 is oversized in the circumferential direction—that is, the length of the slot 40 is greater than the diameter of the body of the bolt 36, as shown best in FIG. 4. Preferably, the slot length, is approximately 3.2 cm (1¼ inch), whereas the bolt body has a diameter of only approximately 1.9 cm (¾ inch). This allows the circumferential location at which the locking pin 26 is fixed to the cylinder 2 to be adjusted, thereby ensuring that both the upstream and downstream locking pins 26 and 28, respectively, can properly engage the outer shroud 6 without the need to provide excessive clearance to account for tolerance build-ups, etc.

In addition, the adjustability in the circumferential positioning of the upstream locking pin 26 allows its projection 42 to be pre-loaded against the side of the notch 30 in the outer shroud rail 12 when the vane airfoil 5 is in its proper Orientation at assembly. This allows the locking pin 26 to be positioned to oppose the motion of the vane 4 in the direction 35 of the force exerted on the vane by the hot gas 7, as shown in FIG. 4, prior to any unwanted motion of the vane.

Although the current invention has been described with reference to a gas turbine, the invention is applicable to other turbo-machines, such as steam turbines. Accordingly, the present invention may be embodied in other specific forms without departing from the spirit or essential attributes thereof and, accordingly, reference should be made to the appended claims, rather than to the foregoing specification, as indicating the scope of the invention.

We claim:

1. A stationary vane assembly for a turbo-machine, comprising:

a) a vane airfoil having a shroud attached thereto, said shroud having first and second ends, one of said ends being disposed upstream of the other one of said ends;

b) a cylinder having means for enclosing a flow of working fluid for said turbo-machine;

c) first locking means for preventing relative motion between said stationary vane airfoil and said cylinder, said first locking means having first means for engaging said cylinder and means for engaging said first end of said shroud; and d) second locking means for preventing relative motion between said stationary vane airfoil and said cylinder, said second locking means having second means for engaging said cylinder and means for engaging said second end of said shroud, said second means for engaging said cylinder having means for adjusting the circumferential location at which said second locking means engages said cylinder.

2. The stationary vane assembly according to claim 1, wherein said means for adjusting the circumferential location at which said second locking means engages said cylinder comprises a slot formed in said second locking means.

3. The stationary vane assembly according to claim 2, wherein said means for adjusting the circumferential location at which said second locking means engages said cylinder further comprises a bolt extending into said cylinder through said slot.

4. The stationary vane assembly according to claim 2, wherein said cylinder has a radially extending flange formed thereon, said second locking means being disposed in a notch in said flange.

5. The stationary vane assembly according to claim 2, wherein said first end of said shroud is disposed downstream from said second end of said shroud with respect to the flow of working fluid through said turbo-machine.

6. The stationary vane assembly according to claim 2, wherein said first locking means comprises a pin extending radially through said cylinder.

7. The stationary vane assembly according to claim 1, wherein said second end of said shroud has means for slidably supporting said shroud on said cylinder.

8. The stationary vane assembly according to claim 7, wherein said means for slidably supporting said shroud comprises a circumferentially extending rail formed on said shroud.

9. The stationary vane assembly according to claim 8, wherein said rail has a notch formed therein, said means for engaging said second end of said shroud comprises a projection formed on said second locking means, said projection having means for entering said notch.

10. In a turbo-machine in which a working fluid flows, a stationary vane assembly to which said working fluid applies a force, comprising:

a) a vane airfoil having a proximal end;

b) a cylinder, said vane airfoil disposed within said cylinder;

c) a shroud formed on said proximal end of said vane airfoil, said shroud having upstream and downstream edges;

d) means for resisting said force applied to said stationary vane airfoil by said working fluid, said force resisting means including a first pin, said first pin having (i) means for engaging said shroud proximate said upstream edge thereof, and (ii) means for engaging said cylinder, said means for engaging said cylinder having means for adjusting the location at which said first pin engages said cylinder.

11. The stationary vane assembly according to claim 10, wherein said means for resisting said force further comprises a second pin having:

a) means for engaging said shroud proximate said downstream edge thereof; and b) means for engaging said cylinder.

12. The stationary vane assembly according to claim 10, wherein said means for adjusting the location at which said first pin engages said cylinder comprises a slot formed in said first pin.

13. The stationary vane assembly according to claim 12 wherein said cylinder further comprises a flange and wherein said means for adjusting the location at which said first pin engages said cylinder further comprises a bolt extending through said slot into said flange.

14. The stationary vane assembly according to claim 13, wherein said means for engaging said cylinder comprises a notch formed in said cylinder flange, at least portion of said first pin being disposed in said notch.

15. The stationary vane assembly according to claim 10, wherein said means for engaging said shroud proximate said upstream edge comprises a notch formed in said shroud, said first pin having a distal end disposed in said notch.

16. The stationary vane assembly according to claim 15, wherein said first pin has a proximal end, said means for engaging said cylinder being formed on said proximal end.

* * * * *